United States Patent [19]

Van Rijn

[11] 4,239,054

[45] Dec. 16, 1980

[54] WATER PRESSURIZING INSTALLATION

[76] Inventor: Antoon J. Van Rijn, Hertog van Beierenstraat 7, Ter Aar, Netherlands

[21] Appl. No.: 960,604

[22] Filed: Nov. 14, 1978

[30] Foreign Application Priority Data

Nov. 15, 1977 [NL] Netherlands ..... 7712585

[51] Int. Cl.[3] ..... F04F 1/06

[52] U.S. Cl. ..... 137/209; 417/118; 417/86

[58] Field of Search ..... 137/209, 206, 210, 116.5; 417/118, 122, 86, 2

[56] References Cited

U.S. PATENT DOCUMENTS

| | | | |
|---|---|---|---|
| 2,132,132 | 10/1938 | Seat | 137/209 |
| 2,976,950 | 3/1961 | Smith | 137/209 X |
| 3,207,175 | 9/1965 | Pauly | 137/116.5 X |
| 3,552,884 | 1/1971 | Faldi | 417/122 |

*Primary Examiner*—Alan Cohan

*Attorney, Agent, or Firm*—William H. Elliott, Jr.

[57] ABSTRACT

A water pressurizing system for use where water pressure from the main is too low. A tank has an inlet for water with a check valve and a discharge outlet for consumption. A gas supply is provided for pressurizing the tank. In the gas supply line there is a U-shaped duct with a float valve in the duct for cutting off the gas supply when the tank is full.

7 Claims, 1 Drawing Figure

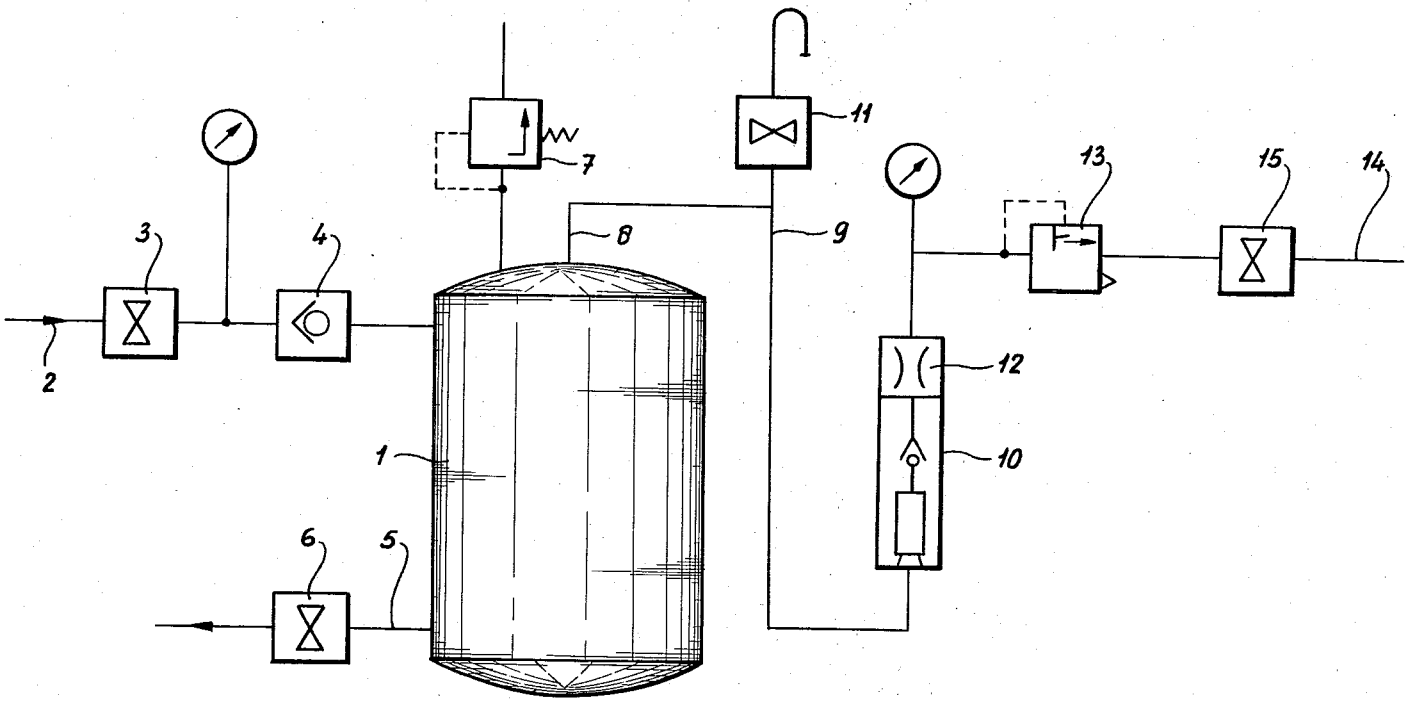
14
15
13
12
10
11
9
8
7
1
5
4
6
3
2

WATER PRESSURIZING INSTALLATION

This invention relates to a water pressurizing installation as auxiliary means to be used in case of too low water pressure from the mains.

Usual water pressurizing installations are mostly used to make tap water available at a sufficient pressure also at high levels in buildings and the like and they usually operate with a water pump and a buffer tank in which a gas pressure is maintained, higher than the supply pressure to the pump. These installations have the disadvantage that they are noisy, often require much maintenance and a rather high energy consumption.

The present invention aims at providing a water pressurizing installation lacking these disadvantages. To this end such an installation is according to the invention characterized in that an inlet for the water supply is connected to a tank, there being a check valve in the supply to this tank and a separate discharge from this tank to one or more consumption discharges such as tap points, a supply duct for gas under pressure being connected to the tank separately from this supply and discharge and being provided with a valve operated by means reacting to the amount of water in the tank in order to close this valve when the tank is full.

This makes it possible to omit pumps and frequently switching valves and the like and a very simple system is obtained which does not use more energy than corresponds to a small quantity of gas under pressure, e.g. air, there being very few moving parts which moreover move in such a way and so infrequently that there is hardly and wear.

When applying the invention all consumed water flows through the tank so that there is no risk of deterioration of the water quality by remaining stagnant for too long a time in the tank.

Preferably such a system is according to the invention further characterized in that the gas pressure from a source of higher pressure such as a pressure gas bottle or compressor, is supplied through a pressure reducing valve with gas pressure relief, the said valve which closes when the tank is full, is positioned between said reducing valve and the tank in such a way that it is possible for the tank to expel gas such as air through the reducing valve when it is being filled. It might seem a complication that a gas compressor (normally with small storing gas container) may be necessary, but a small compressor requiring only little energy is sufficient and it may be a compressor of an oil free type requiring little maintenance and having a long life time, giving anyhow many advantages over a liquid pump. When using a gas pressure bottle this has to be replaced from time to time, which may be done simply and rapidly.

Moreover the valve which closes when the tank is full, is a float valve closing by penetration of water from the tank into it, which lifts the float to close the valve. This gives a very simple and simultaneously a very reliable closing. It is possible to mount this float valve above the tank, but if it is for some reason desired to position it to the side of the tank, e.g. in view of a low ceiling, the tube connecting this valve to the tank will have a U-shaped part or will form such a part together with the interior of the casing of the float valve, so that when supplying gas to the tank some water may remain in the lower part thereof. In view thereof, if this float valve is positioned to the side of the tank, it is preferable to embody the system in such a way that the volume of the float chamber of the valve from the bottom up to the liquid level therein which is just sufficient to close the valve, is greater that the liquid volume which remains as a maximum volume between tank and float chamber when gas is supplied to the tank. Thereby it is avoided that, when filling the tank with water from the mains, the relieving of gas from the tank would prematurely stagnate in that the float valve is moved to closing position by such remaining water.

If the supply pressure of water is very low during a longer period, e.g. when much water is used in warm weather periods, it is preferred to position a separate gas relief valve on the tank, separated in such a way from the supply of gas under pressure thereto that relief of gas from the tank is possible at low pressure with closed supply of gas under pressure. It is thus possible to have the tank fill up with water at the low supply pressure of the water than available with closed connections to the tap points or the like for the water and with closed gas supply by opening such relief valve.

The invention will now be explained in more detail with reference to the enclosed drawing giving diagrammatically a system according to the invention in a preferred embodiment.

A tank 1 is connected near its upper end to a water supply duct 2 from the mains system through a valve 3 and a check valve 4. A discharge duct 5 to consumer points such as tap points opens in the lower part of the tank and has a valve 6. Apart from the usual safety relief means 7 the tank has a connection 8 at its top, leading through a U-shaped duct 9 to a float valve 10. A hand-operated vent or deaerating valve 11 is connected to the highest point of this duct 9. Through a throttle opening 12 the float valve 10 is connected to a reducing valve 13 with deaerating or vent means, which reducing valve is fed by air under pressure from a source 14, via a valve 15. The pressure reducing valve 13 is adjusted to a pressure of e.g. 2.5 bar, lower than the normal water supply pressure through duct 2.

If the water supply pressure has a certain sufficient height, e.g. 3 bar, the tank 1 will be filled through duct 2, the water expelling the air from the tank to the venting reducing valve 13. If the tank is full of water, this water closes the float valve 10. By discharge duct 5 water may be tapped in the usual way.

If the supply pressure from the water mains through duct 2 will decrease to a value below said air pressure at the reducing valve 13, this reducing valve will open to introduce gas through float valve, duct 9, connection 8 and tank 1, so that check valve 4 in supply duct 2 for the water will close. Discharge through duct 5 can go on normally until tank 1 will be empty. As soon as the water supply pressure rises again to above 2.5 bar, the filling of tank 1 will recommence.

The volume of tank 1 should be sufficient to bridge the time in which the water supply pressure may be too low. If, however, this pressure will be too low during a long period, it is possible as an emergency measure to close valve 6 in discharge duct 5 and valve 15 in the supply of air under pressure to valve 13, and to open the vent means at 11. The tank 1 will now be filled by any water entering through duct 2 even if this has a very low pressure.

If the supply pressure of the water would be too low say during a whole day, this is normally no disadvantage if in that period no more than the volume of the tank will be consumed by discharging through duct 5 and as the supply pressure will normally be of sufficient height during the night the tank will be filled again fully in that period.

The structure described does not need any electrical connection or energy supply. In particular for mobile and easily displaceable devices of this kind it may be preferable to have more than one tank connected both at top and at bottom and easily mutually connectable and disconnectable. It is in that case preferred to connect the discharge duct 5 to another tank than the tank to which the supply 2 is connected to obtain a good through-flow of all the tanks.

I claim:

1. A water pressurizing installation as auxiliary means to be used in case of too low water pressure from the mains, characterized in that an inlet for the water supply is connected to a tank, a check valve in the supply to said tank, a separate discharge from said tank to one or more consumption discharges such as tap points, a supply duct for gas under pressure being connected to said tank separately from said supply and discharge and being provided with a float valve reacting to the amount of water in the tank to close said valve when the tank is full, the chamber of the float of said float valve together with the connection between said chamber and said tank forming a U-shaped duct wherein the volume of the float chamber from its bottom to the liquid level therein when the float valve just closes is greater than the maximum liquid volume which remains between the tank and the float chamber when gas is supplied to the tank.

2. A water pressurizing installation comprising a source of water under pressure, the pressure of said water source being subject to periodic fluctuations below a normal pressure range, a tank, a supply conduit connecting said source of water under pressure with said tank, said supply conduit including a check valve permitting flow only toward said tank, a discharge conduit connected with said tank for delivering water to one or more points of consumption, a minimal pressure being required in said tank to effect delivery of water thrugh said discharge conduit upon demand at said points of consumption, a source of pressurized gas, conduit means separate from said water supply and discharge conduits connecting said source of pressurized gas to said tank, means for maintaining the pressure of said gas in said gas supply conduit at a pressure below the normal pressure range of said water source but above the minimal pressure requirement of the discharge conduit, and valve means in said gas supply conduit responsive to the amount of water in said tank for preventing water from reaching said latter means.

3. The invention as claimed in claim 2 wherein said means for maintaining the pressure of said gas in said gas supply conduit comprises a reducing valve in said gas supply conduit for maintaining the pressure of said gas at a predetermined pressure.

4. The invention as claimed in claim 3 including pressure relief means associated with said reducing valve for expelling gas from the tank when it is being filled.

5. The invention as claimed in claim 3 wherein said float valve is positioned between said reducing valve and said tank.

6. The invention as claimed in claim 3 wherein the chamber of the float of said float valve together with the gas supply conduit portion between said chamber and said tank forms a U-shaped duct wherein the volume of the float chamber from its bottom to the liquid level therein when the float valve just closes is greater than the maximum liquid volume which remains between the tank and the float chamber when gas is supplied to the tank.

7. The invention as claimed in claim 2 including valve means in said gas supply conduit and said discharge conduit for closing said conduits, and vent conduit means for connecting said tank to the atmosphere and having valve means therein which can be opened when said gas supply conduit and discharge conduit valves are closed to permit filling of the tank under low pressure conditions of said water source.

* * * * *